US007013016B2

(12) United States Patent
Wolf

(10) Patent No.: US 7,013,016 B2
(45) Date of Patent: Mar. 14, 2006

(54) EAR WAX GUARD

(75) Inventor: Herbert Wolf, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 10/841,141

(22) Filed: May 7, 2004

(65) Prior Publication Data

US 2004/0240694 A1 Dec. 2, 2004

(30) Foreign Application Priority Data

May 9, 2003 (DE) ..... 103 20 861

(51) Int. Cl.
*H04R 25/00* (2006.01)

(52) U.S. Cl. ..... 381/324; 381/325; 381/328

(58) Field of Classification Search ..... 381/309, 381/322, 324, 325, 328, 329, 380, 382, 338; 181/129, 130, 135; 128/864, 867, 868
See application file for complete search history.

(56) References Cited

U.S. PATENT DOCUMENTS

| | | | | |
|---|---|---|---|---|
| 4,972,488 | A * | 11/1990 | Weiss et al. | 381/325 |
| 5,712,918 | A | 1/1998 | Yoest | 381/328 |
| 5,864,628 | A | 1/1999 | Posen et al. | 381/325 |
| 6,795,562 | B1 * | 9/2004 | Gunnersen et al. | 381/325 |

FOREIGN PATENT DOCUMENTS

| | | |
|---|---|---|
| WO | WO 99/07182 | 2/1999 |
| WO | WO 00/03561 | 1/2000 |

* cited by examiner

*Primary Examiner*—Huyen Le
(74) *Attorney, Agent, or Firm*—Schiff Hardin LLP

(57) ABSTRACT

To prevent soiling of a hearing aid, the latter is provided with an exchangeable ear wax guard which, in the area of the sound outlet opening of the hearing aid, can be inserted into a sound tube. The ear wax guard is characterized in that, in order to improve its securing in the sound channel, it is provided with elevations at least in a subarea of its surface. On the surface of the ear wax guard, the density or size of the elevations preferably increases counter to the direction of insertion of the ear wax guard.

10 Claims, 4 Drawing Sheets

EAR WAX GUARD

BACKGROUND OF THE INVENTION

The invention relates to an ear wax guard for a hearing aid which comprises at least a microphone, an amplifier unit and a receiver, in which sound signals picked up by the microphone are amplified in the amplifier unit, are converted into acoustic signals by the receiver, and are delivered via a sound channel to the eardrum, and in which the ear wax guard can be fitted entirely or partially into the sound channel.

International Patent Publication WO99/07182 A2 discloses an acoustic coupler with an ear wax guard. On assembly of the coupler, a receiver is mounted in a housing which is provided with a thread or a toothed surface and in this way can be screwed into the coupler or can be locked in notches of the coupler.

International Patent Publication WO 00/03561 discloses an ear wax guard which can be inserted into the sound outlet opening of a hearing aid and can be removed from this again for replacement. The ear wax guard has a substantially cylindrical outer shape and is provided with a bead via which the ear wax guard is secured in a sound tube. A disadvantage of this securing method is the non-uniform force which is exerted on the sound tube upon insertion of the ear wax guard into the sound tube and upon its removal therefrom. In the least favorable scenario, this can lead to the sound tube coming loose from the housing of the hearing aid in the area of the sound outlet opening. Moreover, the bead can lead to a kind of memory effect in the sound tube. In this way, there is a permanent deformation of the sound tube in the area of the bead. However, this impairs the securing of the ear wax guard in the sound tube and can even lead to its loss.

U.S. Pat. Nos. 5,864,628 and 5,712,918 disclose ear wax guards which, in the area of the sound outlet opening of a hearing aid, can be inserted into and removed from a sound tube. The front end of the known ear wax guard narrows in a frustoconical shape, which makes it easier to insert the ear wax guard into the sound tube. Moreover, the front end has a greater diameter than the remaining part of the ear wax guard to be inserted into the sound tube. In this way too, as in the above-mentioned publication WO 00/03561, a kind of bead is formed which engages in the sound tube and secures the ear wax guard in the sound tube. Therefore, the disadvantages mentioned for publication WO 00/03561 also arise in this case.

SUMMARY OF THE INVENTION

It is an object of the present invention to provide a new design for the securing of an ear wax guard in the sound channel of a hearing aid.

In an ear wax guard for a hearing aid which comprises at least a microphone, an amplifier unit and a receiver, in which sound signals picked up by the microphone are amplified in the amplifier unit, are converted into acoustic signals by the receiver and are delivered via a sound channel to the eardrum, and in which the ear wax guard can be fitted entirely or partially into the sound channel. This object is achieved by the fact that a surface of the ear wax guard for securing in the sound channel is provided with a plurality of elevations which lie on a smooth surface of the sound channel and, as a result of friction, generate a holding action.

According to the embodiments of the invention described below, the ear wax guard is preferably of cylindrical design and is provided with a through-hole, so that the sound generated by the receiver can be conducted through the sound channel and the ear wax guard to the eardrum. Arranged in the through-hole there is advantageously an ear wax retainer which, for example, can be designed as a grate structure or as a disk-shaped element with a plurality of smaller through-openings. In addition to the function of protecting the receiver from soiling, the ear wax guard can also perform an acoustic function as an attenuator, in which case the sound-attenuating effect can be influenced in particular by the choice and arrangement of the elements, such as the ear wax retainer, located in the through-hole. The ear wax retainer can be designed for complete or partial insertion into the sound channel, and in the latter case its diameter at the rear end preferably increases in such a way that complete insertion into the sound channel is prevented.

The invention has the advantage that the force to be applied when inserting the ear wax guard into the sound tube increases continuously and uniformly until the ear wax guard has finally reached its end position. This prevents the sound tube coming loose from the housing of the hearing aid in the area of the sound outlet opening. In addition, it is very unlikely that, upon removal and reinsertion of the ear wax guard, the elevations will come to lie at the same position again. In this way, a memory effect is avoided, and the ear wax guard remains firmly secured in the sound channel even after quite a long period of use.

A special arrangement or design of the elevations can also be used to influence the force applied when inserting the ear wax guard into the sound tube. Thus, in one embodiment of the invention, the density of the elevations, along the insertable housing area, increases counter to the direction of insertion. This means that, in the front area of the ear wax guard inserted first into the sound channel, there are fewer elevations than in a rear area of the ear wax guard. The force to be applied for inserting the ear wax guard thus increases uniformly.

In another embodiment of the invention, the height of the elevations varies between the front area and the rear area of the ear wax guard. In the front area inserted first, the height of the elevations is comparatively low in relation to the height of the elevations in the rear area. In this way too, it is possible to obtain a constant increase in the force to be applied upon insertion of the ear wax guard.

A combination of the two last-mentioned embodiments is also possible. Thus, in a front area of an ear wax guard according to an embodiment of the invention, both the density of the elevations and the height of the elevations can be low by comparison with an area lying farther to the rear. In this way, an even steeper force profile is obtained, i.e., a greater increase in the force to be applied during insertion of the ear wax guard into the sound channel.

A situation in which the ear wax guard falls out of the sound channel when the hearing aid is being worn must absolutely be avoided, because in some circumstances it can be removed from the auditory canal only with difficulty. For this reason, one embodiment of the invention involves specially shaped elevations which ensure that the force to be applied for inserting the ear wax guard into the sound channel is relatively low compared to the force for removing the ear wax guard from the sound channel. This is achieved, for example, by the fact that, starting from the normal surface of the ear wax guard, the elevations rise gradually and constantly, counter to the direction of insertion, and then fall back abruptly from the maximum height of the elevations to the normal surface level. The elevations can also have a design tapering in the direction of insertion. Thus, for example, the elevations have a semi-conical design, the tip of the cone pointing in the direction of insertion.

DESCRIPTION OF THE DRAWINGS

The invention is described below on the basis of illustrative embodiments shown in the drawings.

DETAILED DESCRIPTION OF THE PREFERRED EMBODIMENTS

Figure 1:
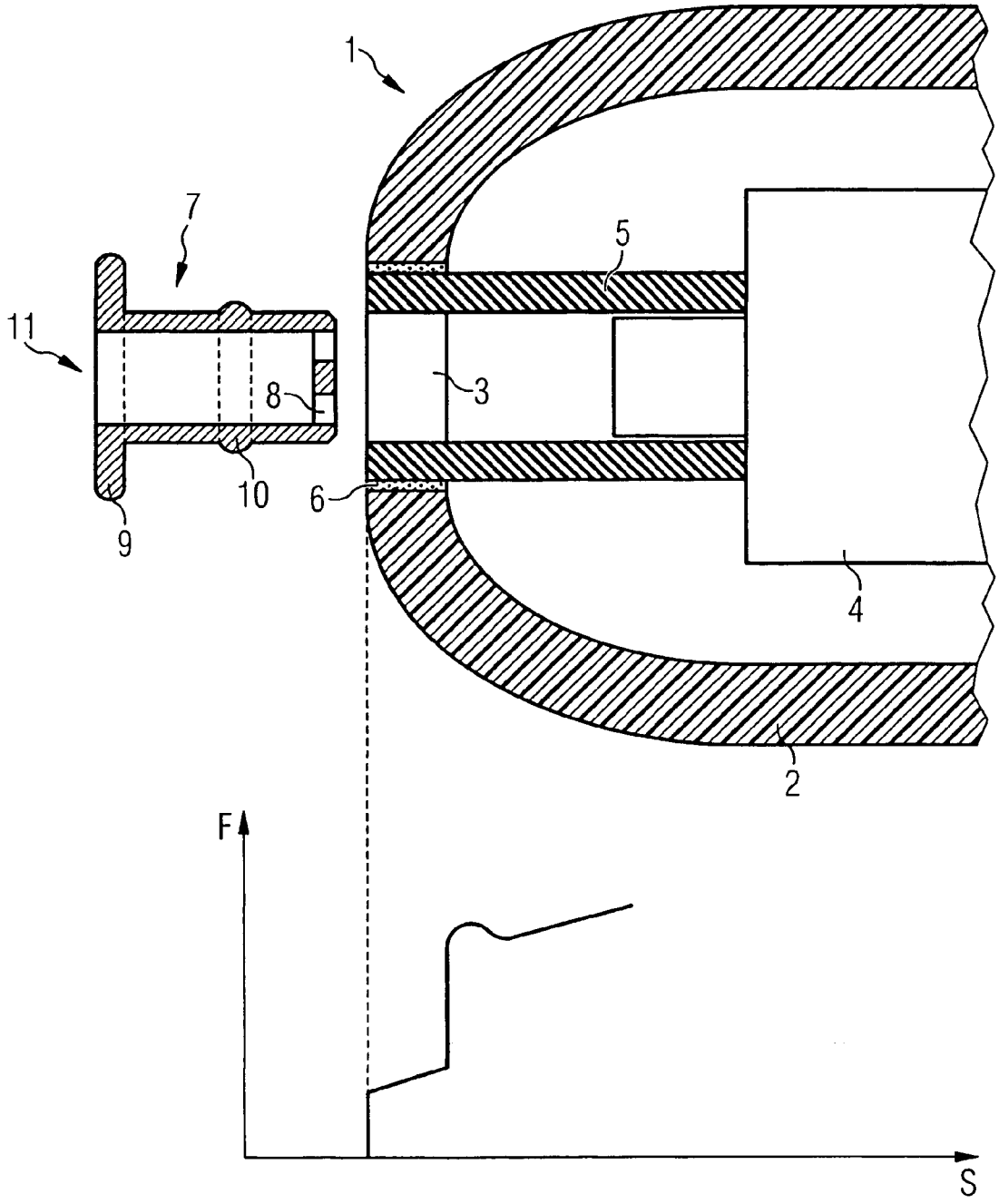
FIG 1 PRIOR ART
FIG. 1 is a section view showing the front end of an in-the-ear hearing aid, and an ear wax guard according to the prior art, along with a graph showing the relationship between force and distance.

FIG. 1 shows the front, proximal end of an in-the-ear hearing aid, and an ear wax guard according to the prior art. The in-the-ear hearing aid 1 comprises a housing 2 with a sound outlet opening 3 arranged in the housing. Arranged inside the housing 2 there is a receiver 4 which is connected to the sound outlet opening 3 via a sound tube 5. In the area of the sound outlet opening 3, the sound tube 5 is usually secured on the housing 2 of the hearing aid 1 via a securing mechanism, for example, an adhesive 6.

To protect the hearing aid 1 from soiling, an ear wax guard 7 is provided which can be inserted partially into the sound tube 5. This ear wax guard is of substantially tubular design, so as to be able to conduct the sound from the receiver 4 into the auditory canal of a hearing aid wearer. The external diameter of the tubular ear wax guard 7 corresponds approximately to the internal diameter of the sound tube 5. In order to prevent penetration of wax into the hearing aid 1, the ear wax guard 7 comprises, in its inside, a grate structure 8 with small sound passages. A collar 9 is formed integrally on the outer end of the ear wax guard 7, this collar 9 preventing complete insertion of the ear wax guard 7 into the sound tube 5. If appropriate, a suitable tool for withdrawing the ear wax guard 7 from the sound tube 5 can also be attached to this collar 9.

An inserted ear wax guard 7 must be secured on the hearing aid 1, and in particular on the sound tube 5, in such a way that inadvertent separation from the hearing aid 1 can be ruled out under normal circumstances. For this reason, the ear wax guard 7 is provided with a circumferential bead 10, so that a friction connection with the sound tube 5 is obtained.

In the diagram associated with FIG. 1, the force F needed for inserting the ear wax guard 7 into the sound tube 5 is plotted along the distance S. The abrupt increase in the force S, in the area in which the bead 10 reaches the sound tube 5, is quite apparent. This force profile also more or less applies, in the reverse direction, upon removal of the ear wax guard 7.

A disadvantage of this arrangement is the abrupt increase in force in the area where the bead 10 reaches the sound tube 5. In the most unfavorable scenario, this can lead to the sound tube 5 coming loose from the housing 2 of the hearing aid 1 in the area of the sound outlet opening 3, for example by separation of the adhesive connection 6. A further disadvantage of this arrangement is that the bead 10 always comes to lie at the same position in the sound tube 5 when the ear wax guard 7 has been inserted, and this results in a permanent deformation of the sound tube 5 at this position (memory effect).

Figure 2:
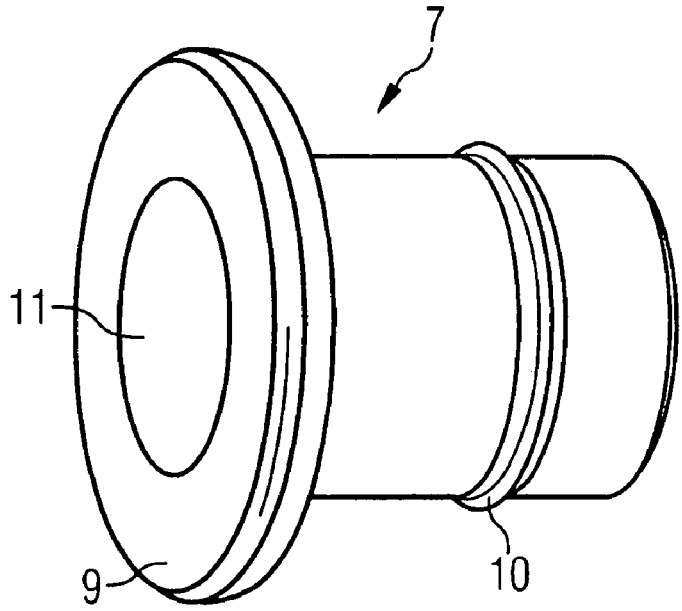
FIG 2 PRIOR ART
FIG. 2 is an isometric view showing the ear wax guard according to the prior art.

FIG. 2 shows the ear wax guard 7 according to the prior art in a three-dimensional isometric view. The cylindrical surface is provided with a circumferential bead 10 which is used to secure the ear wax guard 7 in the sound tube 5. FIG. 2 also shows the collar 9 for preventing complete insertion into the sound channel, and the through-hole 11.

Figure 3:
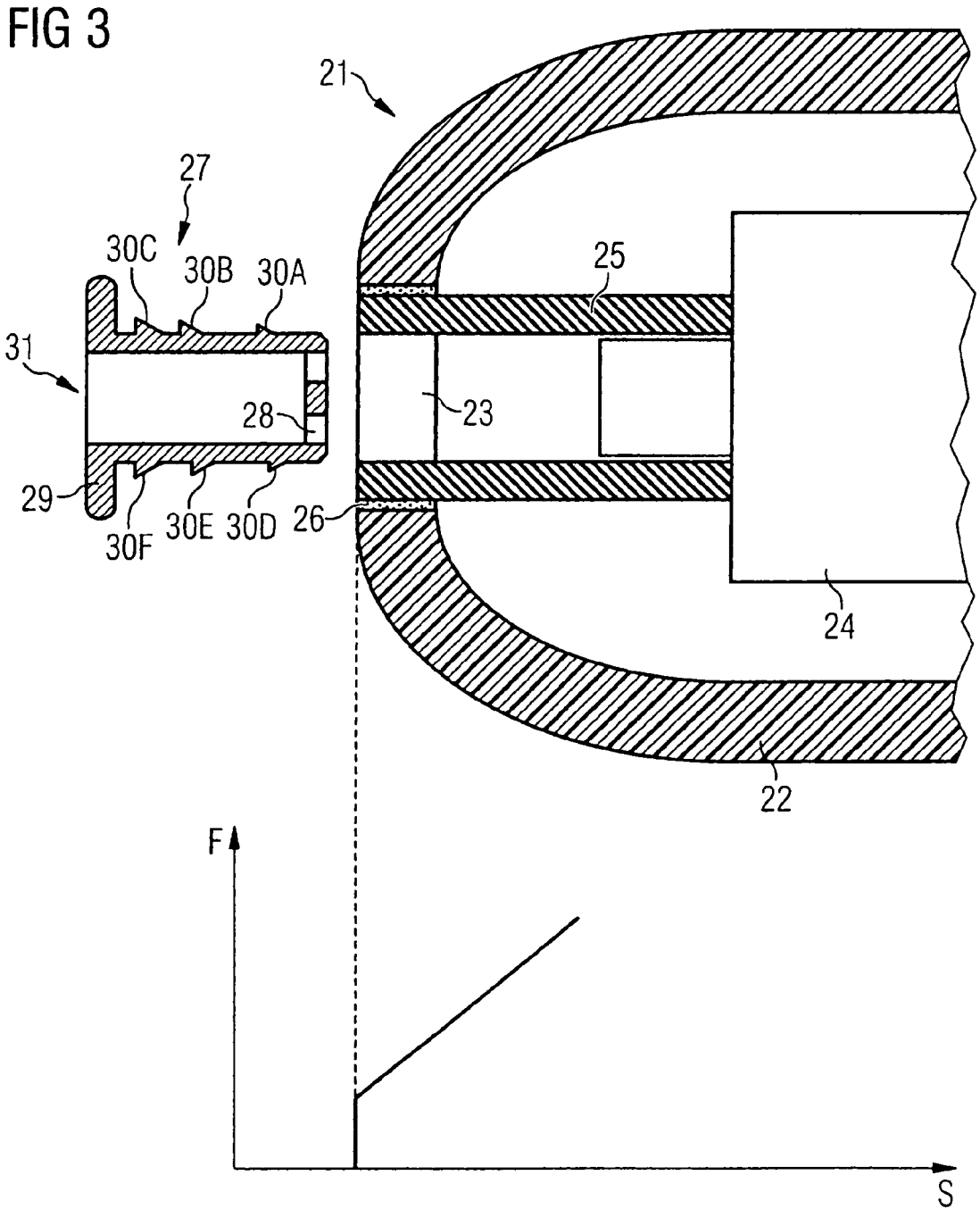
FIG. 3 is a section view showing the front end of a hearing aid, and an ear wax guard according to the invention, along with a graph showing the relationship between force and distance.

Like FIG. 1, FIG. 3 also shows the front, proximal part of an in-the-ear hearing aid 21 with a housing 22, a sound outlet opening 23 in the housing, a receiver 24 arranged inside the housing 22, and a sound tube 25 for connecting the receiver 24 to the sound outlet opening 23. Here too, the sound tube 25 can be secured on the housing 22 by an adhesive connection 26.

The illustrative embodiment of the invention according to FIG. 3 also comprises an ear wax guard 27 which can be inserted to a large extent into a sound tube 25. In contrast to the prior art according to FIG. 1, that part of the surface of the ear wax guard 27 inserted into the sound tube 25 is provided on its surface with elevations, the cross-sectional view in FIG. 3 indicating elevations 30A–30F. The elevations according to the illustrative embodiment are distributed irregularly across the surface of the ear wax guard 27. Moreover, the elevations 30A and 30D in the front area of the ear wax guard 27, which is inserted first into the sound tube 25, are of a smaller size than the elevations 30C and 30F in the rear area of the ear wax guard 27. In addition, the density of the elevations, relative to the surface of the ear wax guard 27, is lower in the front area than in the rear area. This special configuration of the surface of the ear wax guard 27 means there is an almost linearly increasing profile of the force required for inserting the ear wax guard 27 into the sound tube 25 along the distance S. A corresponding force profile is likewise shown in FIG. 3. In this way, it is possible to avoid an abrupt increase in force which could lead to loosening of the adhesive connection 26. Moreover, the irregular arrangement of the elevations means it is very unlikely that these will again come to lie in their previous position upon exchange of the ear wax guard 27. A permanent deformation of the sound tube 25 is thus avoided.

Figure 4:
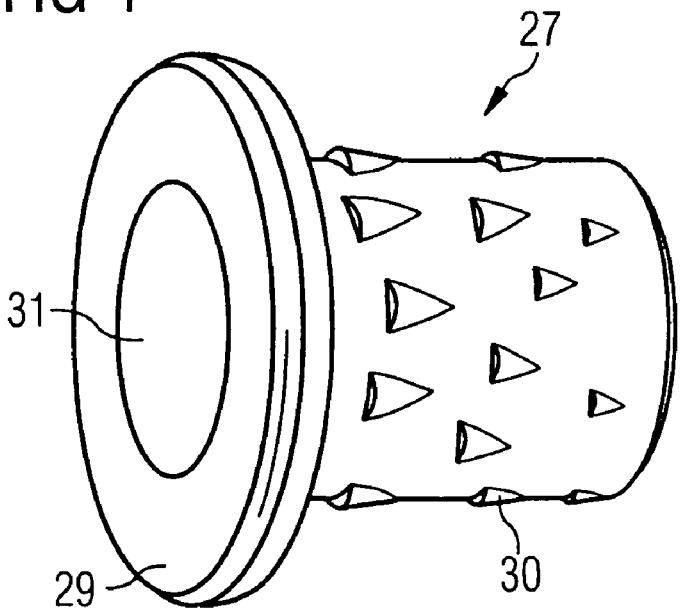
FIG. 4 is an isometric view showing the ear wax guard according to FIG. 3 with triangular elevations.

FIG. 4 shows the ear wax guard according to FIG. 3 in a three-dimensional view. The figure shows the substantially tooth-like design of the elevations 30, with a triangular base surface and a point oriented in the direction of insertion. Both the size and the density of the elevations 30 on the surface of the ear wax guard increase counter to the direction of insertion. The elevations 30 in the illustrative embodiment are designed in such a way that they begin at the level of the surface of the ear wax guard 27 and gradually rise and become wider in the direction toward the rear end of the ear wax guard 27, then fall back abruptly to the starting level. The elevations narrow in the direction of the front end of the ear wax guard. This design has the advantage that the force to be applied for inserting the ear wax guard 27 into the sound tube 25 is less than that for removing it. In this way, insertion is made easier, and inadvertent loosening of the ear wax guard from the sound tube 25 is prevented.

In contrast to the last-mentioned illustrative embodiment, in which both the density and also the size of the elevations

30 increase in the rear area of the ear wax guard, the elevations can, of course, also be of the same size and only increase in the rear area in terms of their density, or increase only in terms of their size while retaining the same density.

Figure 5:
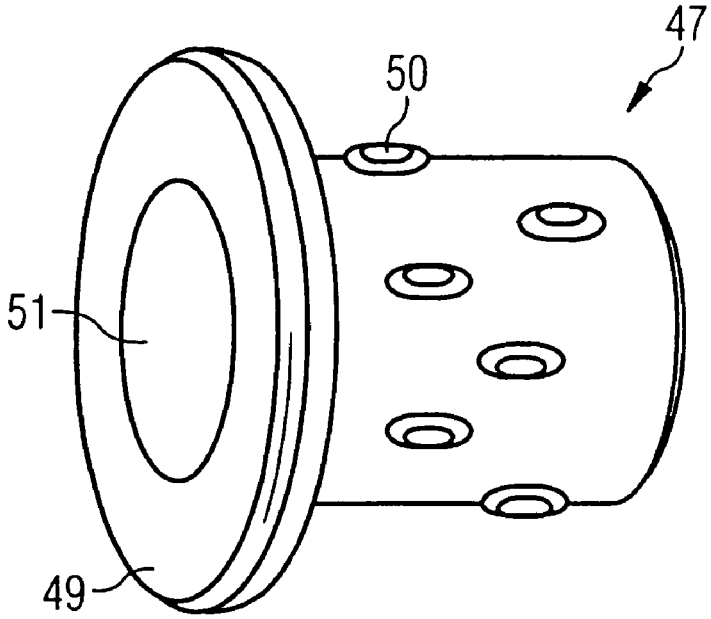
FIG. 5 is an isometric view showing an ear wax guard with oval elevations.

Furthermore, both the density and the size of the elevations can remain the same in the whole area to be inserted into the sound tube. FIG. 5 shows one possible example of this. The ear wax guard 47 shown here, with a through-hole 51 and a collar 49, has oval elevations 50 whose longitudinal direction extends parallel to the direction of insertion. The elevations in this illustrative embodiment are distributed randomly on the surface, but with approximately uniform density. Moreover, all the elevations 50 are at least approximately the same size.

Figure 6:
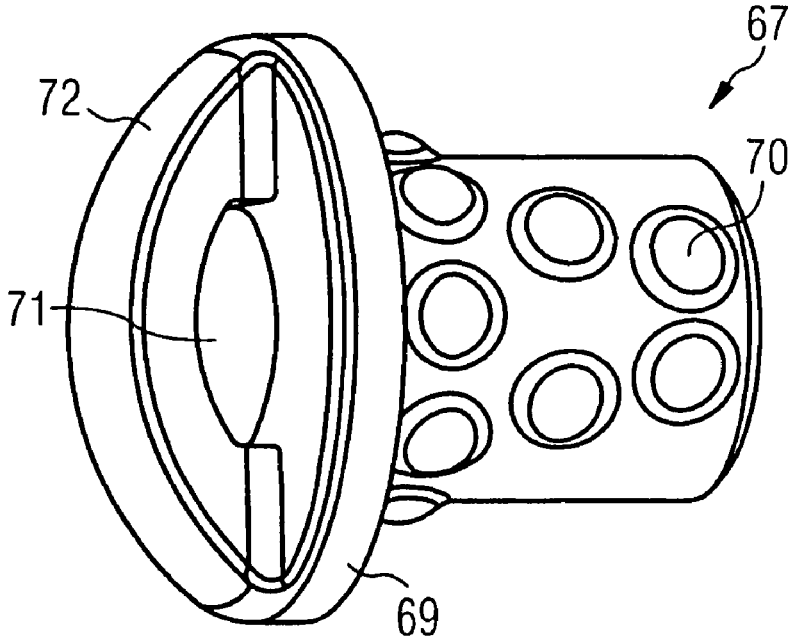
FIG. 6 is an isometric view showing an ear wax guard with round elevations.

A further illustrative embodiment is shown in FIG. 6. Here, an ear wax guard 67, with a through-hole 71 and a collar 69, has round elevations 70 which are likewise distributed irregularly on the surface. The density of the elevations 70 increases in the rear area of the ear wax guard. A further particular is that the ear wax guard 67 is provided with a bow 72 into which a tool can engage for withdrawing the ear wax guard from a sound channel.

The invention is not limited to the illustrated shapes and arrangements of the elevations. For example, the elevations can also be of semispherical design or of any other configuration. In addition, the elevations can also be arranged regularly on the surface of the ear wax guard, for example along straight lines. It is also possible that the ear wax guard has no collar and can be inserted completely into the sound channel.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. An ear wax guard for a hearing aid, the hearing aid comprising a microphone, an amplifier unit and a receiver, in which sound signals picked up by the microphone are amplified in the amplifier unit, are converted into acoustic signals by the receiver and are delivered via a sound tube to the eardrum, and in which the ear wax guard can be fitted entirely or partially into the sound tube, the ear wax guard comprising:

a surface of the ear wax guard for securing in the sound tube having a plurality of elevations which lie on a smooth surface of the sound tube having a frictional fit to generate a holding action, the plurality of elevations defining a means for continuously increasing a force of insertion as the ear wax guard is moved into the sound tube.

2. The ear wax guard as claimed in claim 1, wherein the elevations are distributed irregularly on the surface.

3. The ear wax guard as claimed in claim 1, wherein a density of the elevations on the surface increases in a direction counter to a direction of insertion.

4. The ear wax guard as claimed in claim 1, wherein a size of the elevations on the surface increases in a direction counter to the direction of insertion.

5. The ear wax guard as claimed in claim 1, wherein the elevations are formed asymmetrically in such a way that, starting from a bottom level of the surface of the ear wax guard, the elevations each gradually rise, counter to a direction of insertion, to a maximum elevation height and then fall back abruptly to the bottom level of the surface.

6. The ear wax guard as claimed in claim 5, wherein the elevations have a substantially triangular base surface, a point of a triangle in each case being oriented in the direction of insertion.

7. The ear wax guard as claimed in claim 1, wherein the elevations have a substantially round outer shape.

8. The ear wax guard as claimed in claim 1, wherein the elevations have a substantially oval outer shape.

9. The ear wax guard as claimed in claim 1, further comprising:

a bow which is mounted integrally on a rear end of the ear wax guard, in relation to the direction of insertion, and on which a tool can engage in order to withdraw the ear wax guard from the sound tube.

10. A hearing aid comprising:

a microphone;

an amplifier unit;

a receiver, in which sound signals picked up by the microphone are amplified in the amplifier unit, are converted into acoustic signals by the receiver and are delivered via a sound tube to the eardrum; and an ear wax guard that can be fitted entirely or partially into the sound tube, the ear wax guard comprising:

a surface of the ear wax guard for securing in the sound tube having a plurality of elevations which lie on a smooth surface of the sound tube having a frictional fit to generate a holding action, the plurality of elevations defining a means for continuously increasing a force of insertion as the ear wax guard is moved into the sound tube.

* * * * *